US007306054B2

(12) United States Patent
Hutchinson

(10) Patent No.: US 7,306,054 B2
(45) Date of Patent: Dec. 11, 2007

(54) METHOD FOR IMPROVING DRILLING DEPTH MEASUREMENTS

(76) Inventor: Mark W. Hutchinson, Willowbank House, 84 Station Road, Marlow, Bucks SL7 1NX (GB)

( * ) Notice: Subject to any disclaimer, the term of this patent is extended or adjusted under 35 U.S.C. 154(b) by 0 days.

(21) Appl. No.: 11/429,650

(22) Filed: May 5, 2006

(65) Prior Publication Data

US 2006/0266553 A1 Nov. 30, 2006

Related U.S. Application Data

(60) Division of application No. 10/956,277, filed on Oct. 1, 2004, now Pat. No. 7,044,238, which is a continuation of application No. PCT/US03/10175, filed on Apr. 3, 2003.

(60) Provisional application No. 60/374,117, filed on Apr. 19, 2002.

(51) Int. Cl.
*E21B 47/04* (2006.01)
*E21B 47/09* (2006.01)

(52) U.S. Cl. ..... 175/45; 175/27; 702/9

(58) Field of Classification Search ..... None
See application file for complete search history.

(56) References Cited

U.S. PATENT DOCUMENTS 6,405,136 B1 * 6/2002 Li et al. ..... 702/10

* cited by examiner

*Primary Examiner*—Zakiya W. Bates
(74) *Attorney, Agent, or Firm*—Richard A. Fagin

(57) ABSTRACT

A method for determining a depth of a wellbore includes determining change in a suspended weight of a drill string from a first time to a second time. A change in axial position of the upper portion of the drill string is then determined between the first time and the second time. An expected amount of drill string compression related to the change in suspended weight for movement of a lower portion of the drill string between the first time and the second time is corrected. A position of the lower portion of the drill string is calculated from the change in axial position and the corrected amount of drill string compression.

12 Claims, 10 Drawing Sheets

METHOD FOR IMPROVING DRILLING DEPTH MEASUREMENTS

CROSS-REFERENCE TO RELATED APPLICATIONS

This is a division of application Ser. No. 10/956,277 filed on Oct. 1, 2004, now U.S. Pat. No. 7,044,238, which is a continuation of International Patent Application No. PCT/US03/10175 filed on Apr. 3, 2003. Priority is claimed from U.S. Provisional Application No. 60/374,117 filed on Apr. 19, 2002.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling wellbores through the earth. More particularly, the invention relates to methods for determining actual drilling depth of a drill string in a wellbore with respect to time, and application of the actual depth to drilling process control. The invention further relates to methods for characterizing drilling data on the basis of likely quality, and applications for the characterized data.

2. Background Art

Drilling wellbores through the earth includes "rotary" drilling, in which a drilling rig or similar lifting device suspends a drill string in the wellbore. The drill string turns a drill bit located at one end of the drill string. Equipment on the rig, and/or an hydraulically operated motor disposed in the drill string, rotate the drill bit. The rig lifting equipment is adapted to suspend the drill string so as to place a selected axial force on the drill bit as the bit is rotated. The combined axial force and bit rotation causes the bit to gouge, scrape and/or crush the rocks, thereby drilling a wellbore through the rocks. Typically a drilling rig includes liquid pumps for forcing a fluid called "drilling mud" through the interior of the drill string. The mud is ultimately discharged through nozzles or water courses in the bit. The mud lifts drill cuttings from the wellbore and carries them to the earth's surface for disposition. Other types of rigs may use compressed air as the fluid for lifting cuttings.

The drilling rig typically includes sensors for measuring drilling operating parameters. Such sensors include a "hook load" sensor, which measures the weight being suspended by the lifting equipment on the rig. By measuring the suspended weight, the amount of axial force applied to the drill bit can be inferred from the difference between the total drill string weight (which can be measured and/or calculated) and the suspended weight. The sensors also typically include a device for measuring the vertical position of the lifting equipment within the rig structure. By determining the vertical position and combining therewith a length of the drill string coupled above the drill bit, a depth in the wellbore of the drill bit (and thus the instantaneous depth of the wellbore) can be inferred. Length of the drill string can be determined by adding together the lengths of individual segments of drill pipe and a bottom hole assembly used to turn the bit. The segments and bottom hole assembly components are threadedly coupled and uncoupled by the rig equipment, as is known in the art.

Other rig sensors may include pressure gauges and volume calculators to measure pressure and volume of the mud actually pumped through the drill string. Such measurements can help the wellbore operator determine whether mud is entering the wellbore from formations being drilled, or whether mud is being lost from the wellbore into such formations, among other things.

The instantaneous depth of the wellbore is among the more important measurements made by the various sensors disposed on the drilling rig. Measurements of depth are used in determining the geologic structure of the earth formations being drilled, and there are well known methods for estimating subsurface formation fluid pressures which relate to the rate at which the formations are being drilled. One such method is known in the art as the "drilling exponent" or "d-exponent." The d-exponent is a quantity which is determined with respect to the depth in the wellbore. The relationship between d-exponent and depth is compared to similar correlations made in nearby wellbores which have penetrated similar formations. Deviations of the d-exponent from a locally expected trend with respect to depth is an indication of unexpectedly high or low formation fluid pressures. By acting on such indications, the wellbore operator may avoid expensive and dangerous wellbore pressure control problems. Accurate determination of the d-exponent is based on accurate determination of both drilling depth and the rate at which the drilling depth changes as formations are being drilled, known as rate of penetration ("ROP").

Another important use for instantaneous depth measurements is their ultimate correlation with measurements made by instruments coupled to the drill string, and sensors disposed at the earth's surface. Such instruments include sensors for measuring various physical properties of the formations being drilled, such as electrical conductivity, acoustic velocity, bulk density and natural gamma radiation intensity. The instruments record values related the physical properties with respect to the time of recording. At the earth's surface, a record is made of wellbore depth with respect to time. After the instruments are retrieved from the wellbore, the time-referenced recordings are correlated to the depth-time record. The result is a data set which is correlated to depth within the wellbore at which the measurements were made. As is known in the art, such depth-based records of physical properties of the formation have a number of uses, including determining geologic structures and determining presence of possible formation fluid pressure anomalies. As is the case with determining the d-exponent, determining a precise record of formation properties with respect to depth in the wellbore requires a precise determination of depth with respect to time.

Systems known in the art for determining depth with respect to time, and for determining ROP have proven less than ideal. One limitation of prior art depth measurement techniques using top drive (or kelly) vertical position measurements is that they do not account well for changes in axial length of the drill string as a result of changes in axial load on the drill string. Typically, the length of the drill string is assumed to be substantially constant. Frequently, due to sliding friction between the drill string and the wall of the wellbore, among other factors, the top drive or kelly can move a significant distance before the drill bit moves axially at all. Other methods for determining depth include a fixed correction for the axial length of the drill string. However, such methods only correct drill string length statically. In many cases, the drilling progresses at such a high rate that drill string compression (shortening) due to increases in axial force applied to the drill string does not exactly correspond to the true change in the length of the drill string Depth measurements known in the art and made only from the vertical position measurements, even when such measurements are corrected for drill string loading, are thus subject to error. ROP determination is directly related to depth measurement, and thus is correspondingly subject to error using depth measurement methods known in the art. It is therefore desirable to have a system for improving the measurement of bit depth so that more precise records of depth with respect to time, and better quality calculations based on depth may be made.

Another aspect of prior art data recording techniques is that there are not any well known, systematic methods for determining which data are more suitable for interpretation and analysis. During the drilling process, the drill string and BHA may undergo shock, vibration, torsional oscillations or whirl. Aside from the destructive nature of these modes of motion, data recorded during times when the drill string or BHA undergo such motion may be less reliable than when drilling is proceeding smoothly. It is desirable to have a method for discriminating data on the basis of drilling operating parameters and mode of motion such that data recorded under preferred drilling conditions may be selectively identified for analysis.

SUMMARY OF THE INVENTION

One aspect of the invention is a method for determining a depth of a wellbore. The method includes determining change in a suspended weight of a drill string from a first time to a second time. A change in axial position of the upper portion of the drill string between the first time and the second time is determined. An expected amount of drill string compression related to the change in suspended weight is corrected for movement of a lower portion of the drill string between the first time and the second time. A position of the lower portion of the drill string is calculated from the change in axial position and the corrected amount of drill string compression.

In one embodiment, the correcting includes estimating drill bit movement by determining an axial motion of the drill string at the earth's surface between two times having a same suspended weight of the drill string.

Another aspect of the invention is a method for classifying data measured during drilling operations at a wellbore. This aspect of the invention includes determining a first difference between values of a selected parameter measured between a first time and a second time. Determining the first difference in some embodiments is repeated for other times. Data values are assigned to an enhanced data value set during times when the first difference falls below a selected threshold.

In some embodiments, a second difference of data values is determined. Data values are assigned to the enhanced data set when either or both the first and second difference fall below respective selected thresholds. In another embodiment, the data values are assigned to the enhanced data set when at least one of drilling control parameters, drilling motion measurements, the first difference and the second difference fall either above or below selected thresholds.

Another aspect of the invention is a method for selecting drilling operating parameters. A method according to this aspect of the invention includes determining a correspondence between at least one drilling operating parameter and at least one drilling response parameter. The determining of the correspondence is performed when a drill string motion parameter falls below a selected threshold. The at least one drilling response parameter and at least one drilling operating parameter are characterized according to a lithology. The at least one drilling operating parameter and at least one drilling operating parameter are measured during drilling. Lithology is determined from the measured parameters, and the at least one drilling operating parameter is selected to optimize the at least one drilling response parameter for the determined lithology.

Another aspect of the invention is a method for determining a drilling malfunction. A method according to this aspect of the invention includes determining a correspondence between at least one drilling operating parameter and at least one drilling response parameter. A value of the drilling response parameter is predicted based on the correspondence and measurements of the drilling operating parameter, and existence of a malfunction is determined when the predicted value is substantially different from a measured value of the drilling response parameter.

Other aspects and advantages of the invention will be apparent from the following description and the appended claims.

BRIEF DESCRIPTION OF THE DRAWINGS

FIG. 8 shows an example of using a trained neural network to predict drilling response in certain formations, and using actual response compared thereto to determine drilling malfunction.

DETAILED DESCRIPTION

Figure 1:
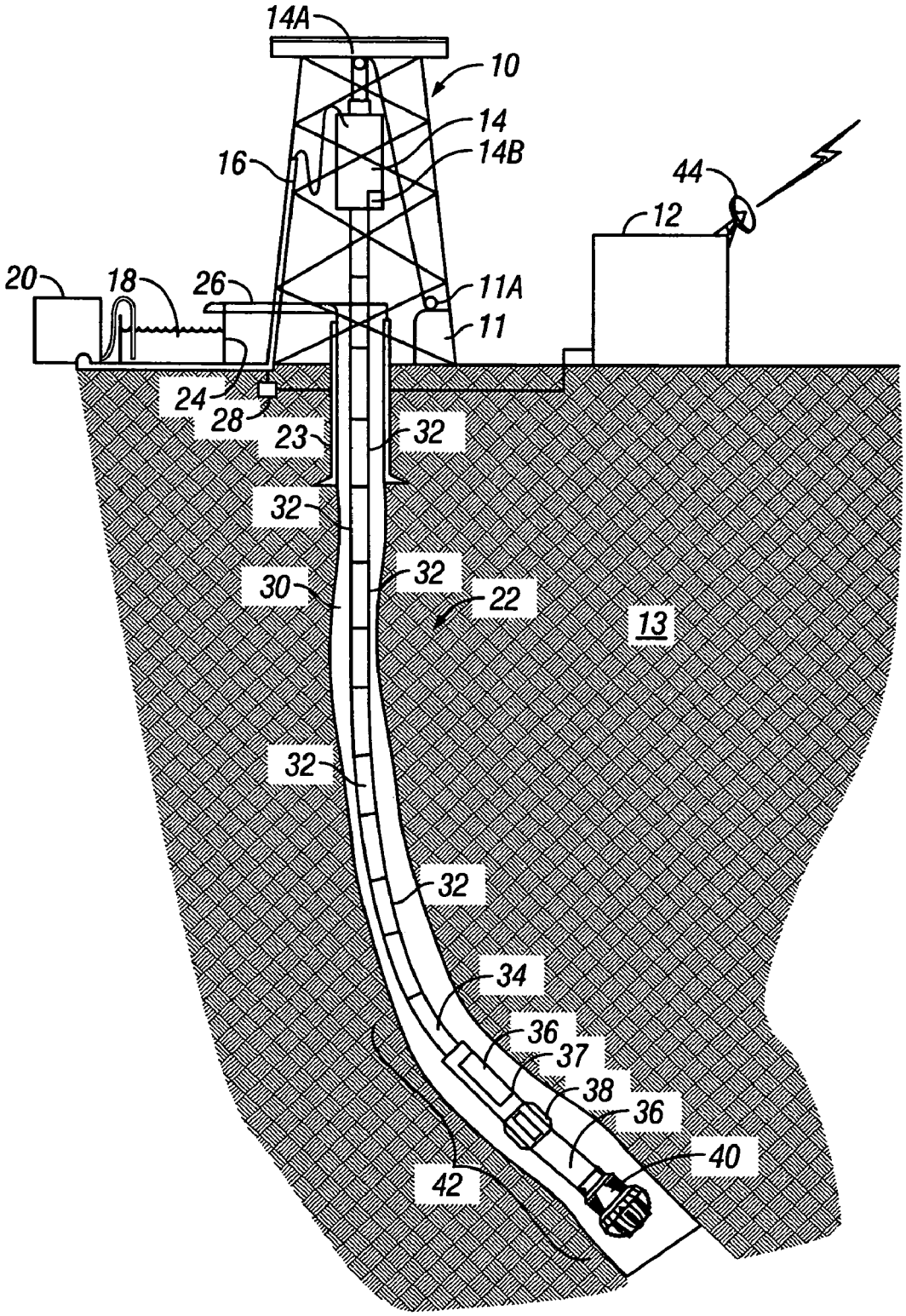
FIG. 1 shows a typical wellbore drilling operation.

FIG. 1 shows a typical wellbore drilling operation from which data may be measured and used with various embodiments of the invention. A drilling rig 10 includes a drawworks 11 or similar lifting device known in the art to raise, suspend and lower a drill string. The drawworks 11 for purposes of this description is described collectively and includes a hook, traveling block, wire rope or cable spooled by a winch, and other lifting and control devices well known in the art for lifting and suspending a drill string.

The drill string includes a number of threadedly coupled sections of drill pipe, shown generally at 32, that extend to the earth's surface at one end. A lowermost part of the drill string is known as a bottom hole assembly (BHA) 42. The BHA 42 includes, in the embodiment of FIG. 1, a drill bit 40 at the lowermost end to cut through earth formations 13 below the earth's surface. The drill bit 40 may be one of many types well known in the art, including roller cone or fixed cutter bits. The BHA 42 may also include various devices such as heavy weight drill pipe 34, and drill collars 36. The BHA 42 may also include one or more stabilizers 38 that include blades thereon adapted to keep the BHA 42 roughly in the center of the wellbore 22 during drilling.

In various embodiments, one or more of the drill collars 36 may include measurement while drilling (MWD) sensors and a mud-pulse telemetry unit (collectively referred to as the "MWD system"), shown generally at 37. The purpose of the MWD system 37 and the types of sensors therein will be further explained below with reference to FIG. 2.

The drawworks 11 is operated during active drilling (actual deepening of the wellbore 22 by operation of the drill bit 40) so as to apply a selected axial force to the drill bit 40, known in the art as weight on bit ("WOB"). The axial force, as is known in the art, results from the weight of the drill string, a large portion of which is suspended by the drawworks 11 which transfers the weight to the rig 10 and thus to the surface of the earth (or to a platform or floating rig in marine drilling operations). At least part of the unsuspended portion of the weight of the drill string is transferred to the bit 40 as axial force. In some embodiments, a sensor 14A known as a hook load sensor may be used to determine the amount of suspended weight carried by the drawworks 11. The measurements of suspended weight can be used by the rig operator to operate the drawworks so as to selectively control the WOB. Purposes for the hook load measurements as related to the invention will be further explained below.

The bit 40 is rotated by turning the pipe 32, using a rotary table/kelly bushing (not shown in FIG. 1) or preferably a top drive 14 (or power swivel) of any type well known in the art. Other embodiments of a BHA may include an hydraulically powered motor ("mud motor"—not shown) which turns the drill bit 40. Rotation of such hydraulic motor (not shown) may be in addition to the rotation provided by the top drive 14 or in substitution thereof. The top drive 14 may also include a sensor (not shown) for measuring the amount of torque applied to the pipe 32. Alternatively, the applied torque may be inferred by measuring an amount of electric current drawn by a motor (not shown) in the top drive 14, as is well known in the art. If the top drive 14 is hydraulically or pneumatically powered, the torque may be inferred from pressure drop and flow rate of the drive fluid.

While the pipe 32 (and consequently the BHA 42 and bit 40 as well) is suspended in the wellbore 22, a pump 20 lifts drilling fluid ("mud") 18 from a pit or tank 24 and moves it through a standpipe/hose assembly 16 to the top drive 14 so that the mud 18 is forced through the interior of the pipe segments 32 and then the BHA 42. Ultimately, the mud 18 is discharged through nozzles or water courses (not shown) in the bit 40, where it lifts drill cuttings (not shown) to the earth's surface through an annular space between the wall of the wellbore 22 and the exterior of the pipe 32 and the BHA 42. The mud 18 then flows up through a surface casing 23 to a wellhead and/or return line 26. After removing drill cuttings using screening devices (not shown in FIG. 1), the mud 18 is returned to the tank 24.

The drawworks 11 may include thereon a sensor 11A for determining the vertical position of the top drive 14 within the rig structure. The instantaneous vertical position of the top drive 14 is combined with lengths of the pipe segments 32 and the lengths of the components of the BHA 42 (collectively "drill string length") to determine the instantaneous depth of the bit 40. Measurements of bit depth according to embodiments of the invention will be further explained below. In some embodiments, the sensor 11A is coupled to appropriate circuits (not shown) in a recording unit 12 to make a depth/time record. The recording unit 12 may also record measurements of the hook load from sensor 14A, and may also record torque applied by the top drive 14. The recording unit 12 can be one of many types well known in the art for surface logging and/or MWD recording.

The standpipe system 16 in this embodiment includes a pressure transducer 28 which generates an electrical or other type of signal corresponding to the mud pressure in the standpipe 16. The pressure transducer 28 is operatively connected to systems (not shown separately in FIG. 1) inside the recording unit 12 for decoding, recording and interpreting signals communicated from the MWD system 37. As is known in the art, the MWD system 37 includes a device, which will be explained below with reference to FIG. 2, for modulating the pressure of the mud 18 to communicate selected data to the earth's surface. In some embodiments the recording unit 12 includes a remote communication device 44 such as a satellite transceiver or radio transceiver, for communicating data received from the MWD system 37, and other sensors at the earth's surface (e.g., torque hook load 14A and position 11A), to a remote location. Such remote communication devices are well known in the art. The data detection and recording elements shown in FIG. 1, including the pressure transducer 28 and recording unit 12 are only examples of data receiving and recording systems which may be used with the invention, and accordingly, are not intended to limit the scope of the invention.

Generally speaking, various embodiments of the invention are adapted to be run on the recording system 12 or on a remote computer (not shown) to enable recording and interpretation of measurements made by the various sensors described herein. Some embodiments comprise instructions recorded on a computer-readable medium adapted to cause a computer (not shown separately) in the recording system 12 to carry out steps as will be explained below with reference to FIGS. 4-7.

Figure 2:
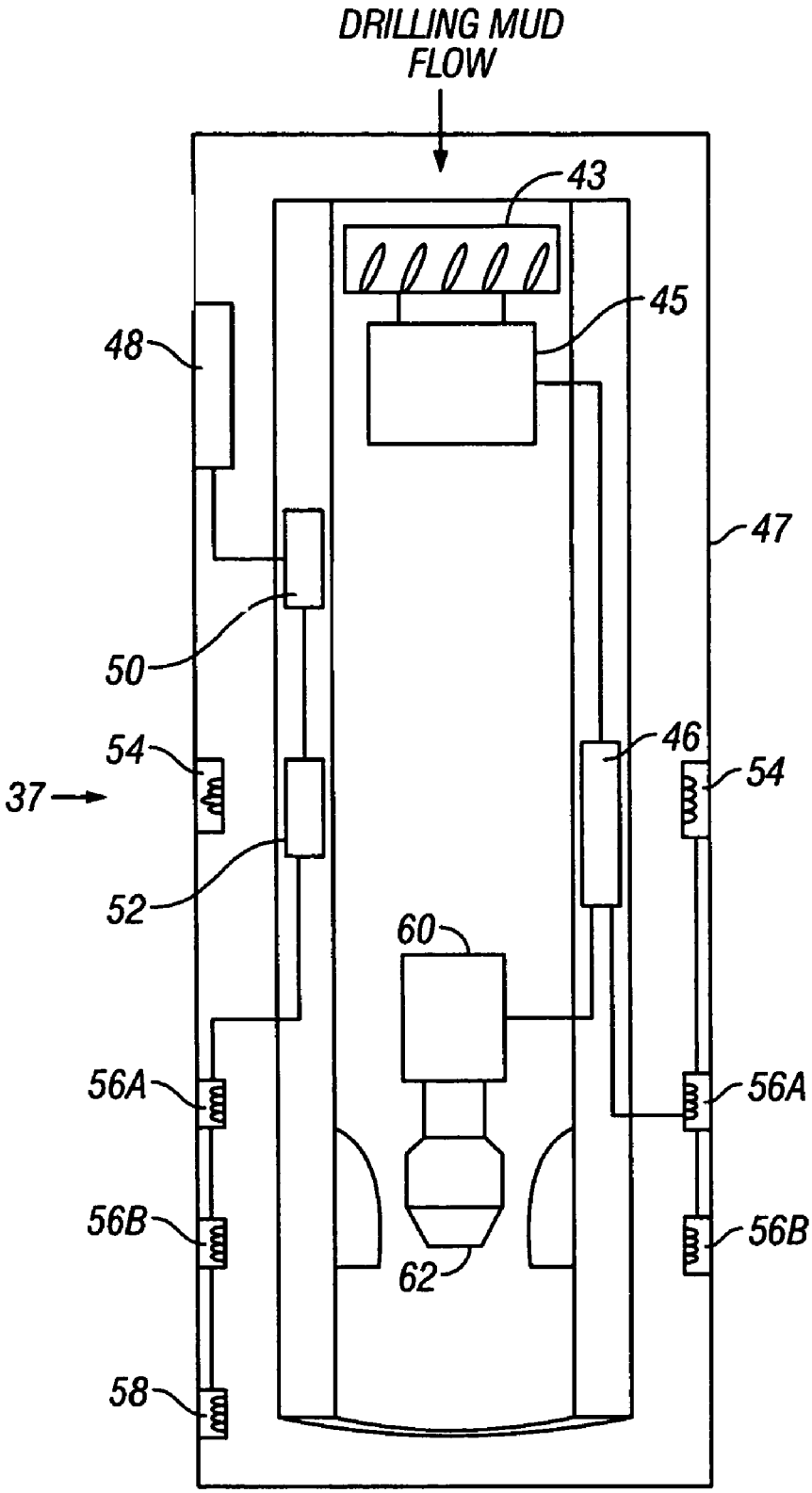
FIG. 2 shows parts of a typical MWD system.

One embodiment of an MWD system, such as shown generally at 37 in FIG. 1, is shown in more detail in FIG. 2. The MWD system 37 is typically disposed inside a non-magnetic housing 47 made from monel or the like and adapted to be coupled within the drill string at its axial ends. The housing 47 is typically configured to behave mechanically in a manner similar to other drill collars (36 in FIG. 1). The housing 47 includes disposed therein a turbine 43 which converts some of the flow of mud (18 in FIG. 1) into rotational energy to drive an alternator 45 or generator to power various electrical circuits and sensors in the MWD system 37. Other types of MWD systems may include batteries as an electrical power source.

Control over the various functions of the MWD system 37 may be performed by a central processor 46. The processor 46 may also include circuits for recording signals generated by the various sensors in the MWD system 37. In this embodiment, the MWD system 37 includes a directional sensor 50, having therein tri-axial magnetometers and accelerometers such that the orientation of the MWD system 37 with respect to magnetic north and with respect to earth's gravity can be determined. The MWD system 37 may also include a gamma ray detector 48 and separate rotational (angular)/axial accelerometers, acoustic calipers, magnetometers and/or strain gauges, shown generally at 58. The MWD system 37 may also include a resistivity sensor system, including an induction signal generator/receiver 52, and transmitter antenna 54 and receiver 56A, 56B antennas. The resistivity sensor can be of any type well known in the art for measuring electrical conductivity or resistivity of the formations (13 in FIG. 1) surrounding the wellbore (22 in FIG. 1).

The central processor 46 periodically interrogates each of the sensors in the MWD system 37 and may store the interrogated signals from each sensor in a memory or other storage device (not shown separately) associated with the central processor 46. As is known in the art, the recorded sensor signals are indexed with respect to the time each record is made, so that when the MWD system 37 is removed from the wellbore (22 in FIG. 1), it can be coupled to an appropriate data link (not shown) in the recording system (12 in FIG. 1) to generate a depth-based record of the sensor signals. The depth-based record is generated by correlating the time-indexed recorded data from the MWD system to a time-depth record made in the recording system (12 in FIG. 1). Time-indexed recording and later correlation to a time-depth record is known in the art. See, for example, U.S. Pat. No. 4,216,536 issued to More. As will be further explained below with reference to FIGS. 4 and 5, one aspect of the invention is related to generating improved time-depth records in the recording system (12 in FIG. 1).

Some of the sensor signals may be formatted for transmission to the earth's surface in a mud pressure modulation telemetry scheme. In the embodiment of FIG. 2, the mud pressure is modulated by operating an hydraulic cylinder 60 to extend a pulser valve 62 to create a restriction to the flow of mud through the housing 47. The restriction in mud flow increases the mud pressure, which is detected by transducer (28 in FIG. 1). Operation of the cylinder 60 is typically controlled by the processor 46 such that the selected data to be communicated to the earth's surface are encoded in a series of pressure pulses detected by the transducer (28 in FIG. 1) at the surface. Many different data encoding schemes using a mud pressure modulator such as shown in FIG. 2 are well known in the art. Accordingly, the type of telemetry encoding is not intended to limit the scope of the invention. Other mud pressure modulation techniques which may also be used with the invention include so-called "negative pulse" telemetry, wherein a valve is operated to momentarily vent some of the mud from within the MWD system to the annular space between the housing and the wellbore. Such venting momentarily decreases pressure in the standpipe (16 in FIG. 1). Still other mud pressure telemetry includes a so-called "mud siren", in which a rotary valve disposed in the MWD housing 47 creates standing pressure waves in the mud, which may be modulated using such techniques as phase shift keying for detection at the earth's surface. Irrespective of the actual telemetry scheme used, signals detected by the recording system (12 in FIG. 1) are recorded, and typically are indexed with respect to the time and correlative depth at which the signals were actually detected.

In some embodiments, each component of the BHA (42 in FIG. 1) may include its own rotational and axial accelerometer or strain gauge sensor. For example, referring back to FIG. 1, each of the drill collars 36, the stabilizer 38 and the bit 40 may include such sensors. The sensors in each BHA component may be electrically coupled, or may be coupled by a linking device such as a short-hop electromagnetic transceiver of types well known in the art, to the processor (46 in FIG. 2). The processor 46 may then periodically interrogate each of the sensors disposed in the various components of the BHA 40 to make motion mode determinations according to various embodiments of the invention. For purposes of this invention, either strain gauges, magnetometers or accelerometers may be used to make measurements related to the acceleration imparted to the particular component of the BHA and in the particular direction described. As is known in the art, torque, for example, is a vector product of moment of inertia and angular acceleration. A strain gauge adapted to measure torsional strain on the particular BHA component would therefore measure a quantity directly related to the angular acceleration applied to that BHA component. Accelerometers and magnetometers have the advantage of being easier to mount inside the various components of the BHA, because their response does not depend on accurate transmission of deformation of the BHA component to the accelerometer or magnetometer, as is required with strain gauges. However, it should be clearly understood that for purposes of defining the scope of this invention, it is only necessary that the property measured be related to the component acceleration being described. An accelerometer adapted to measure rotational (angular acceleration) would preferably be mounted such that its sensitive direction is perpendicular to the axis of the BHA component and parallel to a tangent to the outer surface of the BHA component. The directional sensor 50, if appropriately mounted inside the housing 47, may thus have one component of its three orthogonal components which is suitable to measure angular acceleration of the MWD system 37. The purpose of making such acceleration and/or strain measurements as it relates to the invention will be explained below with reference to FIG. 6.

Figure 3:
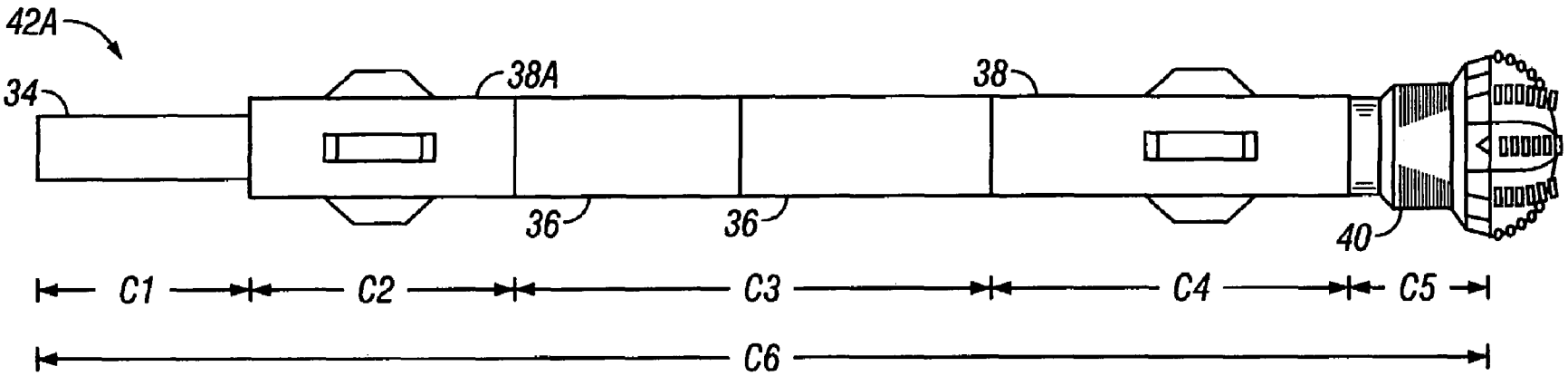
FIG. 3 shows an example of a bottom hole assembly (BHA) in more detail.

FIG. 3 shows another example of a BHA 42A in more detail for purposes of explaining the invention. The BHA 42A in this example includes components comprising a bit 40, which may be of any type known in the art for drilling earth formations, a near-bit or first stabilizer 38, drill collars 36, a second stabilizer 38A, which may be the same or different type than the first stabilizer 38, and heavyweight drill pipe 34. Each of these sections of the BHA 42A may be identified by its overall length as shown in FIG. 3. The bit 40 has length C5, the first stabilizer 38 has length C2, and so on as shown in FIG. 3. The entire BHA 42A has a length indicated by C6.

As explained in the Background section herein, and as may be inferred from the explanation above with respect to FIGS. 1 and 2, an important aspect of making measurements of parameters related to the drilling process and to measurements of formation properties using the MWD system (37 in FIG. 1) is ensuring that the measurements are correctly correlated with the actual depth of the drill bit (40 in FIG. 1) within the wellbore (22 in FIG. 1). As is known in the art, the vertical distance of the drill bit 40 from the earth's surface (known in the art as true vertical depth—"TVD") may be determined from the length of the drill string disposed in the wellbore (22 in FIG. 1) and the actual trajectory of the wellbore (22 in FIG. 1). Wellbore trajectory may be determined from inclination and azimuth measurements made at selected positions or continuously along the wellbore using well known survey techniques and calculation methods. Conversely, depth of the bit referenced to the length of the drill string disposed in the wellbore is known in the art as "measured depth." Irrespective of whether the particular depth index used is TVD or measured depth, it is important to be able to precisely determine the measured depth of the bit at any point in time. One embodiment of a method for determining the measured depth with respect to time is explained with reference to the flow chart in FIG. 4.

During the drilling process, either in the recording system (12 in FIG. 1) or in a separate data recorder (not shown), a record is made with respect to time of measurements made by each of the sensors on the rig (10 in FIG. 1). The sensor recordings include recordings of the top drive (or kelly) vertical position made by the position sensor (11A in FIG. 1), and the suspended drill string weight, determined from the hook load sensor (14A in FIG. 1). In some embodiments, an additional sensor (not shown) may measure the rotational speed of the top drive (14 in FIG. 1) or the drill string (in kelly table/kelly type drilling rigs). The rotational speed is referred to as "RPM." In other embodiments, RPM may be inferred from measurements made by the magnetometers in the MWD system (37 in FIG. 2).

Figure 4:
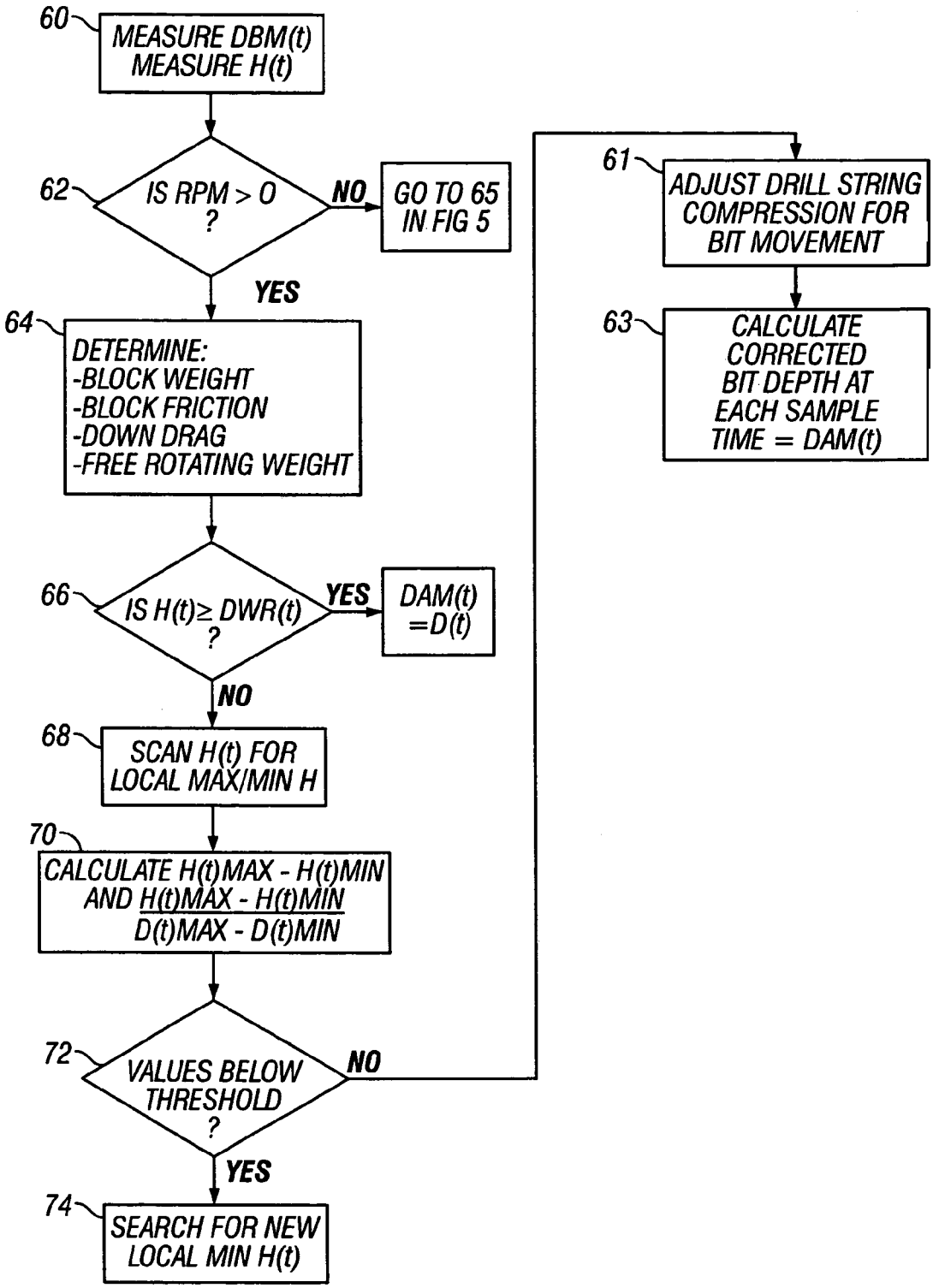
FIG. 4 shows a flow chart of one embodiment of a depth measurement method according to the invention.

At 60 in FIG. 4, a time-indexed record is made of the vertical position of the hook, or vertical position or top drive, represented by DBM(t), the hook load, represented by H(t), the drill string rotation rate, represented by RPM(t).

To calculate depth, in this embodiment, as shown at 62, the following values are established either by modeling, user input, or from measurements made by the sensors on the drilling rig. Modeling may include using a drilling engineering program sold under the trade name WELLPLAN by Landmark Graphics, Houston, Tex. The values to be established may include the block weight (weight of the top drive or hook assembly), the free rotating weight (the weight of the drill string compensated for its buoyancy in the drilling mud), block friction (friction force needed to move the top drive up and down which may also be related to speed of motion of the top drive), block velocity (axial speed of motion of the top drive or hook assembly), rotation speed (RPM), and the down-drag forces (frictional force of axial motion between the wellbore wall and the drill string). The result of obtaining any or all of the foregoing parameters is to determine the expected hook load under the condition of the drill string moving (rotationally and/or axially) with normal friction within the wellbore. The expected hookload under a rotating condition is known as the "down weight rotating" (DWR)

The RPM sensor is interrogated, as shown at 64. If the drill string rotation rate, RPM(t), is greater than zero, the mode of drilling operations is determined to be "rotating" or "rotary drilling", and the calculation technique shown in FIG. 4 continues. If the drill pipe is not rotating (RPM(t) equals zero), then the process will continue as will be explained below with respect to FIG. 5.

The process accepts as input at the time of calculation (t), values of the apparent bit depth D(t), which is related to the top drive vertical position (block height) at time t and an apparent (uncorrected) axial length of the drill string. The input also includes the measured hookload H(t). As previously explained, these values are measured, at 60.

When the drill string is moving downward in the wellbore and is rotating, under the condition that the hookload is greater than or equal to the expected hookload at the time of measurement, namely $H(t) \geqq DWR(t)$, then the corrected bit depth, DAM(t), is set equal to the apparent bit depth, or, DAM(t)=D(t). This is shown at 66 in FIG. 4.

At 66 in FIG. 4, for time intervals when H(t) is less than DWR(t), in this embodiment the values of H(t) are scanned within a selected number of time samples ahead of the time of measurement to determine local maximum and minimum values of H(t). The times and hookload values at which these local maximum and minimum values take place can be identified by $H(t)_{max}$ and $H(t)_{min}$. This is shown at 68 in FIG. 4. Then, as shown at 70 in FIG. 4, the difference in hookload values between the local minimum and subsequent maximum hookload values is determined:

$$H(t)_{max}-H(t)_{min}$$

The difference in hookload in the above equation is compared to a selected threshold, as shown at 72 in FIG. 4. If the value is below the selected threshold, then the minimum value, $H(t)_{min}$ is not used in calculating drill string length compression correction factors, and another minimum value of hookload is searched, as shown at 74. The threshold will be related to the changes in weight on bit (axial force) applied by the drilling rig operator (driller) during operation of the drilling rig.

If the threshold is exceeded, the hookload values are scanned back from the time of the minimum hookload, $H(t)_{min}$, until a value of hookload is found which is greater than or of equal to the value to the maximum hookload subsequent to the minimum hookload. A time interval is determined between the subsequent maximum hookload and the found, prior hookload. If the time interval is longer than a selected threshold, then another minimum value is searched from the hookload measurements. If the prior maximum is greater than the subsequent maximum, then the next smaller hookload value is used with the prior maximum to interpolate an expected time at which the hookload would be exactly the same as the subsequent maximum hookload value. This time can be referred to as the prior maximum hookload time (t)pmx. The apparent bit depth at the time of the prior maximum hookload value, referred to as $D(t)_{pmx}$ should also be interpolated from the time/apparent bit depth measurements. An apparent rate of penetration at the time of minimum hookload can then be determined by the expression:

$$ROP(t)_{min}=(D(t)_{max}-D(t)_{pmx})/(t_{max}-t_{pmx})$$

Then, a value for drill string compression adjusted for bit movement at the time of the minimum hookload, $K(t)_{min}$ is then determined from the following equation:

$$K(t)_{min}=(D(t)_{min}-D(t)_{pmx}-(ROP(t)_{min}\times(t_{min}-t_{pmx})))/(H(t)_{max}-H(t)_{min})$$

The values of $K(t)_{min}$ in determined according to the above expression can then be linearly interpolated with respect to depth. This is shown at 61 in FIG. 4.

$$DAM(t)=D(t)-K(t)\times(DWR(t)-H(t))$$

Correcting the bit depth is shown at 63 in FIG. 4.

Going back to 64 in FIG. 4, if the RPM is equal to zero, the drilling mode is known as "sliding." Sliding drilling, as is known in the art, is performed under certain conditions using a motor powered by the flow of drilling fluid disposed in the BHA. Such motors are known in the art as "mud motors."

Figure 5:
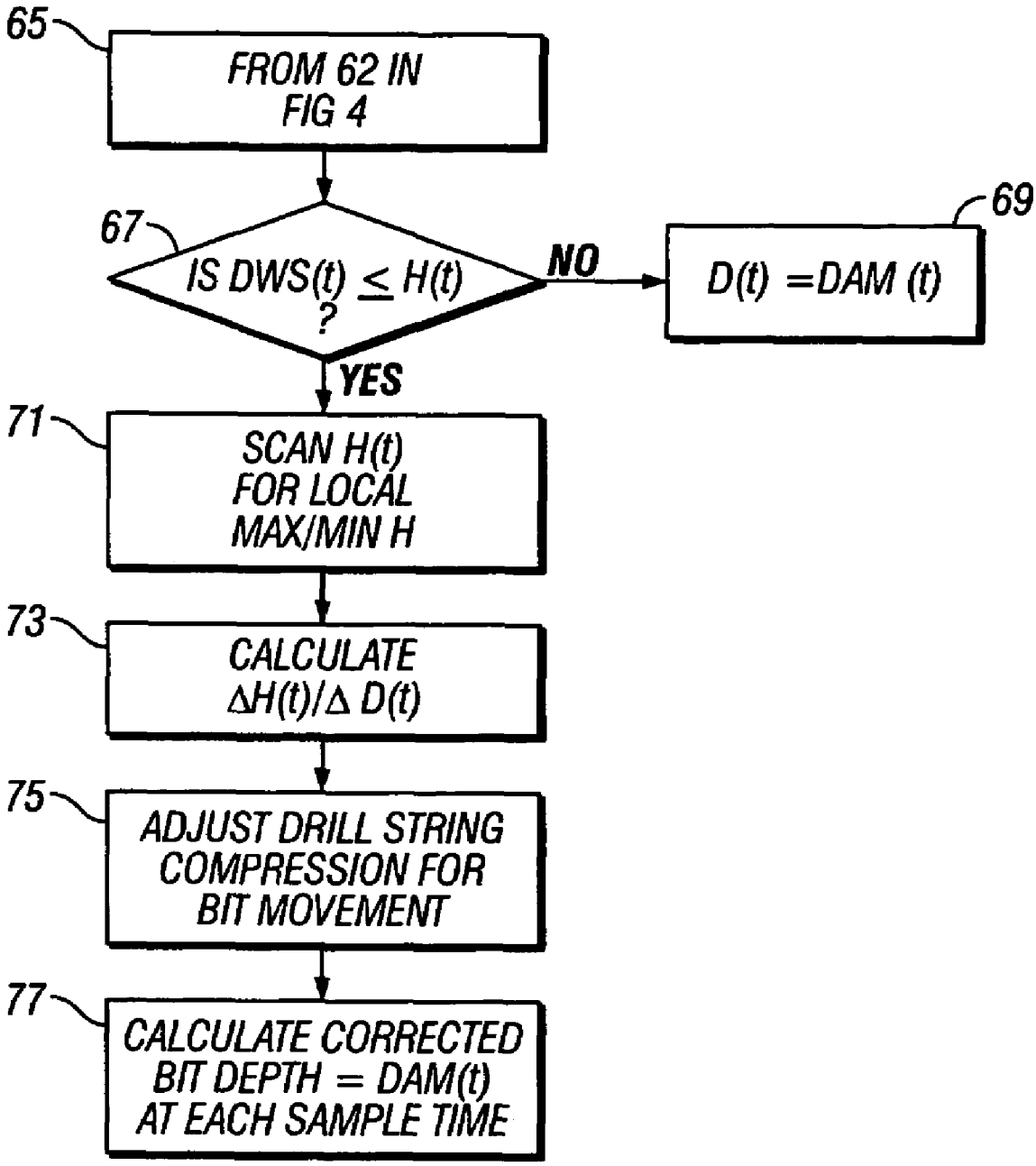
FIG. 5 is a flow chart of one embodiment of a depth measurement method according to the invention.

If the drilling mode is sliding, a different expected hookload can be determined, called DWS(t), using a model, user input or drilling rig sensor data as described above with respect to FIG. 4. Referring to FIG. 5, when sliding, for intervals when the expected hookload is equal to or greater than the expected hookload when the drill string is axially sliding down, the corrected bit depth can be set equal to the apparent bit depth, just as in the previous embodiment for rotary drilling. This is shown generally at 67 and 69 in FIG. 5. In intervals where H(t) is less than DWS(t), then the process continues substantially as explained above with respect to rotary drilling. At 71, H(t) values are scanned for local maxima and minima. Values of rate of change of hookload with respect to depth are calculated as shown at 73. At 75, an amount of drill string compression is adjusted with respect to rate of penetration at the drill bit, and finally, at 77, corrected values of depth, DAM(t), at each sample time are determined.

The corrected values of depth with respect to time, DAM(t), can then be then used to re-compute times when in on-bottom drilling modes as well as new ROP curves, logging while drilling (LWD) processed formation data, time-depth and depth-time transformations and further calculations such as drilling exponents (d-exponent), lithology and pore pressure. Pore pressure, in some embodiments, may be determined from the drilling exponent, as is well known in the art.

Figure 6:
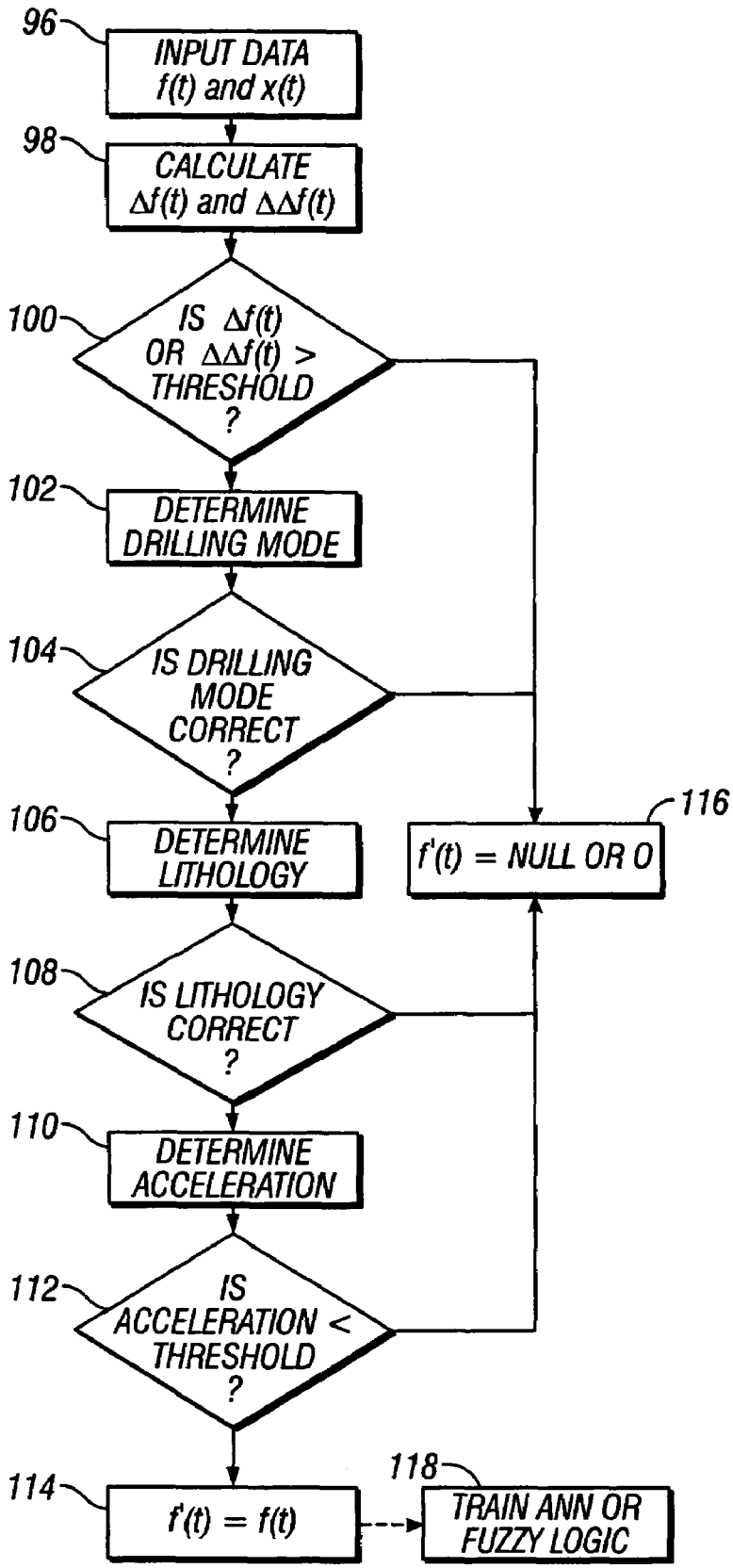
FIG. 6 is a flow chart of one embodiment of a method for determining an enhanced data set.

Referring to FIG. 6, another aspect of the invention relates to data classification in order to improve interpretation of selected data. A recording of each type of data made in the recording system (12 in FIG. 1) at each time, t, may be referred to by the notation f(t). A complete data recording thus includes, at 96 in FIG. 6, a value of various recorded parameters corresponding to each recording time. The recording may include values of parameters measured by the sensors at the earth's surface, including the top drive position sensor, hook load sensor and the torque sensor, for example. The recording may also include values of parameters measured by the various sensors in the MWD system (37 in FIG. 1) which are communicated by the mud telemetry as previously explained. The recording may also include values of parameters recorded in the MWD system (37 in FIG. 1), and linked to the recording system (12 in FIG. 1) after the MWD system is removed from the wellbore. In still other embodiments, the MWD system may include a system for communicating signals representing sensor measurements to the earth's surface substantially in real time for recording by the recording system. Such real time communication may be performed where the segments of pipe (32 in FIG. 1) include an electromagnetically coupled signal line, such as disclosed in U.S. Patent Application Publication Ser. No. 20020075114 A1 filed by Hall et al. The drill pipe disclosed in the Hall et al. application includes electromagnetically coupled wires in each drill pipe segment and a number of signal repeaters located at selected positions along the drill string for communicating signals to the earth's surface from an instrument disposed in a wellbore.

In a process according to this aspect of the invention, the data are preferably categorized according to at least one of the first difference of another measurement Δf(t) (as explained more fully below) a second difference of another measurement ΔΔf(t) (as explained more fully below), the type of operation taking place on the drilling rig (10 in FIG. 1) which may be related to the bit depth determined in the previous method (described with respect to FIGS. 4 and 5), the mode of motion of the drill string as determined from the values of some acceleration parameter and an associated lithology, as determined by methods well known in the art.

In the present embodiment, at 98, for each value of parameter, f(t), a first difference, Δf(t) between each parameter value and the immediately previous parameter value may be determined. A value of a second difference, Δ(Δf(t)), may also be determined between the current first difference value and a first difference value for the successive measured parameter.

$$\Delta f(t)=f(t)-f(t-1)$$

$$\Delta(\Delta f(t))=\Delta f(t+1)-\Delta f(t)$$

In some embodiments, if the value of the first difference exceeds a pre-selected threshold, shown at 100 in FIG. 6, then the measured parameter value at time t is not assigned to the enhanced data set and the representative value of f'(t) is set to a default value such as zero or null. This is shown generally at 116 in FIG. 6. An example of a measured parameter that can be discriminated on the basis of the first difference is the velocity of motion of the top drive (14 in FIG. 1). Another example of a parameter that can be discriminated using the first difference is the rotation rate of the drill string, RPM. First difference with respect to depth of the formation gamma-ray signal measured downhole using the sensors in the MWD system (37 in FIG. 1), that is transformed into the time domain using depth-time transforms known in the art, may also be used to discriminate data which are to be included in the enhanced data set. Another example of a parameter that can be discriminated on the basis of the first difference is torque applied to the drill string by the top drive and measured at the surface. First difference of the torque measured downhole using the sensors in the MWD system (37 in FIG. 1) may also be used to discriminate data which are to be included in the enhanced data set. In some embodiments, if either the value of first difference and/or second difference exceeds pre-selected thresholds, at 100 in FIG. 6, then the current parameter values f(t) may be recorded as a default value such as zero or null in the enhanced data f'(t), as shown at 116 in FIG. 6. It should be understood that the enhanced data type may be different than the data type used to determine the first and second differences. Examples of parameters that may be discriminated using the first and second differences include the vertical position of the top drive (also known as "block height"), and rotary orientation of the drill string, which may be measured at the surface or using the sensors in the MWD system (37 in FIG. 1).

In some embodiments the data classification may be enhanced by determining the drilling mode of operation, using various drilling control parameters such as, but not limited to, rotation rate of the drill string (RPM), pump rate (flow), rate of penetration (ROP) and axial velocity of the top drive, shown generally at 102 in FIG. 6. For example, by determining places where the ROP is non-zero and the RPM is greater than zero, the data may be classified as recorded during "rotary drilling". If ROP, as may be determined from the method represented in FIGS. 4 and 5, is zero or the RPM is zero, in this example, the recorded data are not representative of those recorded during rotary drilling of the wellbore. At 104 in FIG. 6, if the data are classified as not being recorded during rotary drilling, then a value of the enhanced data at time t for a parameter, represented by f'(t), may be set to a default value such as zero or null, shown at 116 in FIG. 6. In some embodiments, different drilling mode operations, for examples tripping in, tripping out, forward-reaming and back-reaming may be used to discriminate whether measured data are, or are not ultimately included in the enhanced data set.

Some embodiments for enhancing the quality of data used in subsequent analyses, discriminate data based upon the lithology associated with data at different time intervals, for example the lithology being drilled at time t, shown generally at 106 in FIG. 6. Often lithology is recorded by formation sensors in the depth domain. A depth-time transformation, the inverse of time-depth transformations well known in the art, may be required in order to use lithology for discrimination of data in the time domain at any time t. At 108 in FIG. 6, if the data are classified as not corresponding to a particular lithology, then the value at time t of enhanced data values for a parameter, represented by f'(t), may be set to a default value such as zero or null, shown at 116 in FIG. 6.

Some embodiments of calculating an enhanced data set includes discriminating the data as measured with respect to whether or not the drill string is in a mode of motion which dissipates some of the drilling energy by transferring the energy into the drill string and/or the side of the wellbore, instead of transferring the drilling energy efficiently to the drill bit. Examples of such dissipative drilling modes include, without limitation, whirl, lateral vibration, axial vibration, shocks, stick slip and torsional vibrations. In the present embodiment, and referring to FIG. 6, a parameter related to at least one of the following is measured: angular acceleration; axial acceleration and lateral acceleration. This is shown at 110 in FIG. 6. Any of these parameters may be measured at the surface, or may be measured by various sensors in the MWD system (37 in FIG. 1). For example, vertical position of the top drive (14 in FIG. 1) may be measured and doubly differentiated with respect to time to obtain the axial acceleration of the drill string at the earth's surface. Other embodiments may include an acceleration sensor or strain gauge coupled to the top drive or hook. Correspondingly, the acceleration along the drill string axis may be directly measured by the sensors in the MWD system (37 in FIG. 1). As another example, torque may be measured at the earth's surface, and variations in the measured torque can be used as an indication of the angular acceleration of the drill string. Alternatively, torque and/or angular acceleration may be measured by the various sensors in the MWD system (37 in FIG. 1). As another example, lateral acceleration of the drill string may be measured by the various sensors in the MWD system (37 in FIG. 1).

At 112 in FIG. 6, the measured parameter related to the one or more accelerations is compared to a selected threshold. The threshold value is related to which particular acceleration-related parameter is being measured. If, at 112 the parameter does not exceed the selected threshold, then the values of the sensor measurements at that point in time may be included in the enhanced data set, wherein $f'(t)=f(t)$, shown at 114 of FIG. 6. If the acceleration-related parameter exceeds the selected threshold, at 112 of FIG. 6, then the data values of the enhanced data set may be set to a default value, such as zero or null, as shown at 116 of FIG. 6.

Examples of drilling and or formation evaluation parameters that may be discriminated (as to whether included in an enhanced data set) using the foregoing embodiment include, without limitation, rotary speed of the drill string (RPM), mud pump rate (or mud flow rate), standpipe (drilling fluid) pressure, axial force on the bit (WOB) measured either at the surface or downhole, rate of penetration (ROP) and torque applied to the drill string at surface.

One purpose of selecting data for inclusion in a so-called "enhanced" data set according to this aspect of the invention is to identify data which are associated with preferred drilling intervals under preferred drilling conditions, so as to enhance interpretation made from these selected data. For example, formation density measurements made by the sensors in the MWD system (37 in FIG. 1) in an enhanced data set may represent more closely the actual earth formation properties when a sensor is consistently in contact with or oriented towards the formation being measured. As another example, measurements of weight on bit, torque at the bit, RPM of the bit or rate of penetration may not be representative of the force required to drill a particular formation if there is a substantial amount of axial, angular and/or lateral vibration in the drill string. Accordingly, in one embodiment, the values of first and second difference of values of torque recorded at the surface and angular and/or axial and lateral acceleration recorded in the MWD system (37 in FIG. 1) are compared to a selected threshold. Values of first and/or second difference which exceed the selected threshold indicate that the BHA and/or drill string are undergoing excessive vibration or are undergoing torsional "stick slip" or "whirl" motion. Data values recorded during intervals of such unfavorable (dissipative) drill string motion may be excluded from preferred interpretation techniques such as drilling exponent and pore pressure calculations known in the art.

One important application for generating a "preferred" data set as explained above with respect to FIG. 6 is providing input data for training a neural network or fuzzy logic algorithm adapted to optimize and/or control drilling operating parameters and/or to affect selection of hydraulic (mud) motor and/or drill bit design parameters. Using the preferred data set to train an artificial neural network (ANN) is shown at 118 in FIG. 6. Methods for training neural networks to control drilling operating parameters and bit design parameters are disclosed in U.S. Pat. No. 6,424,919 B1 issued to Moran et al. and incorporated herein by reference. In embodiments of the present invention, time-based values of control parameters that are used to train a neural network to optimize drilling performance include weight on bit, drilling mud flow rate and rotary speed of the bit. During training of the neural network, values of the control parameters are recorded with respect to the output parameter. In some embodiments, for example, the output parameter may be cost per unit depth drilled. In other embodiments, for example, the output parameter may be rate of penetration. In other embodiments, the output parameter may be surface torque magnitude. In embodiments of the present invention, only data from the preferred data sets are used to train the neural network. Advantageously, embodiments of a method for training a neural network according to the invention may have reduced training time, and improved correlation between the control parameters and the output parameters because more reliable and representative values of control parameter are used.

Figure 7:
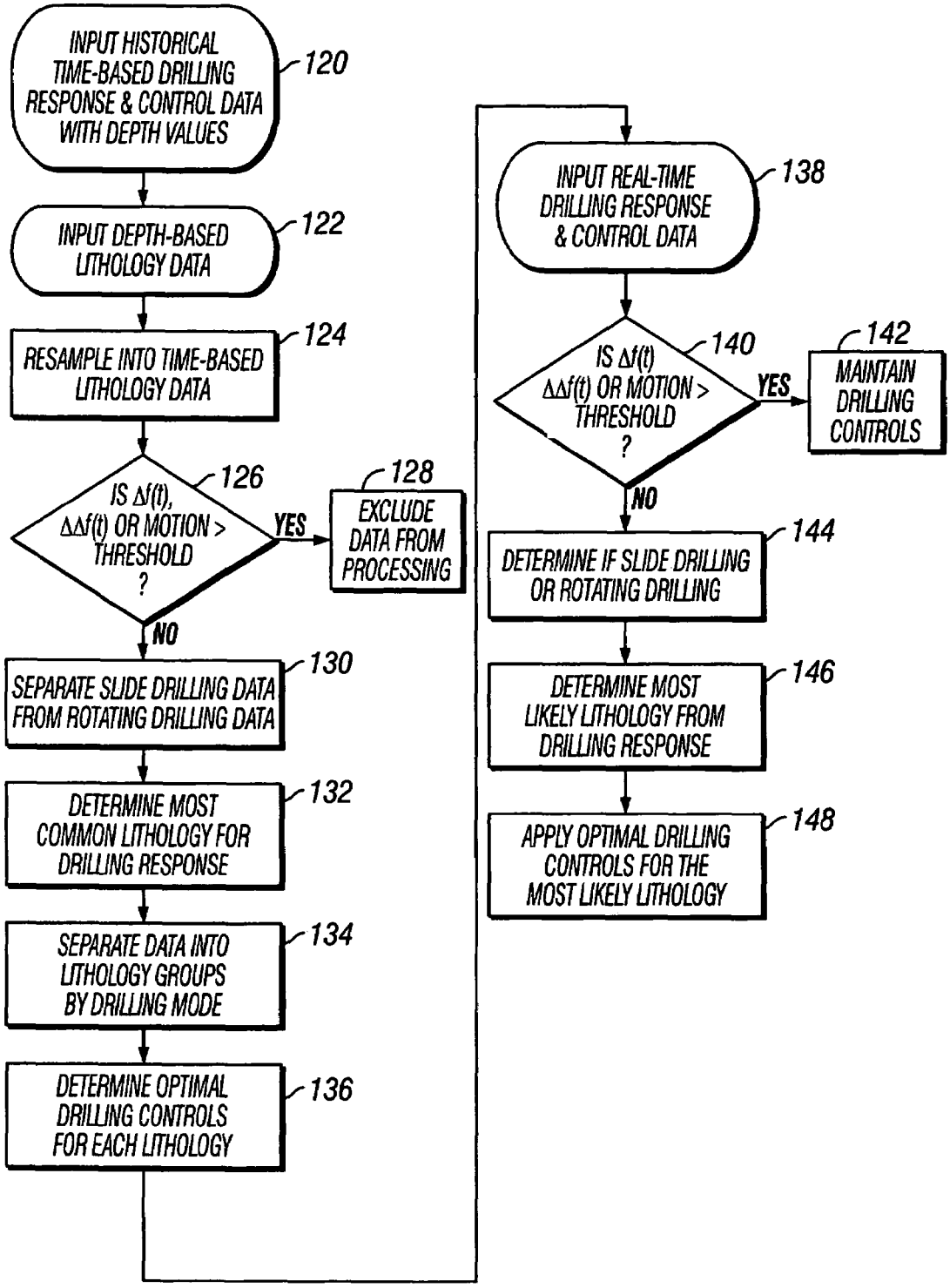
FIG. 7 shows an example process for controlling drilling operations using enhanced data such as those characterized according to the process of FIG. 6.
Figure 9:
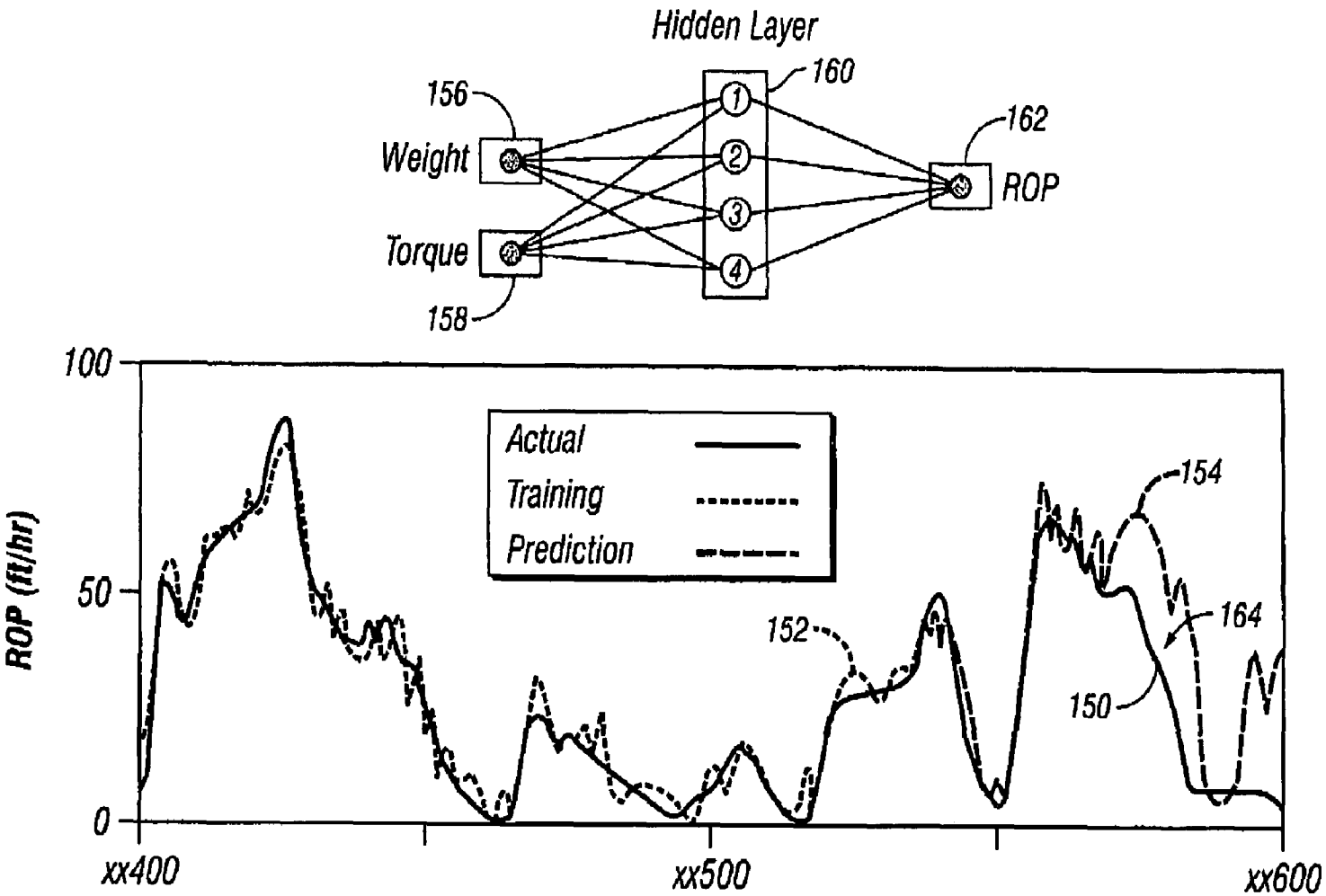
Figure 9:
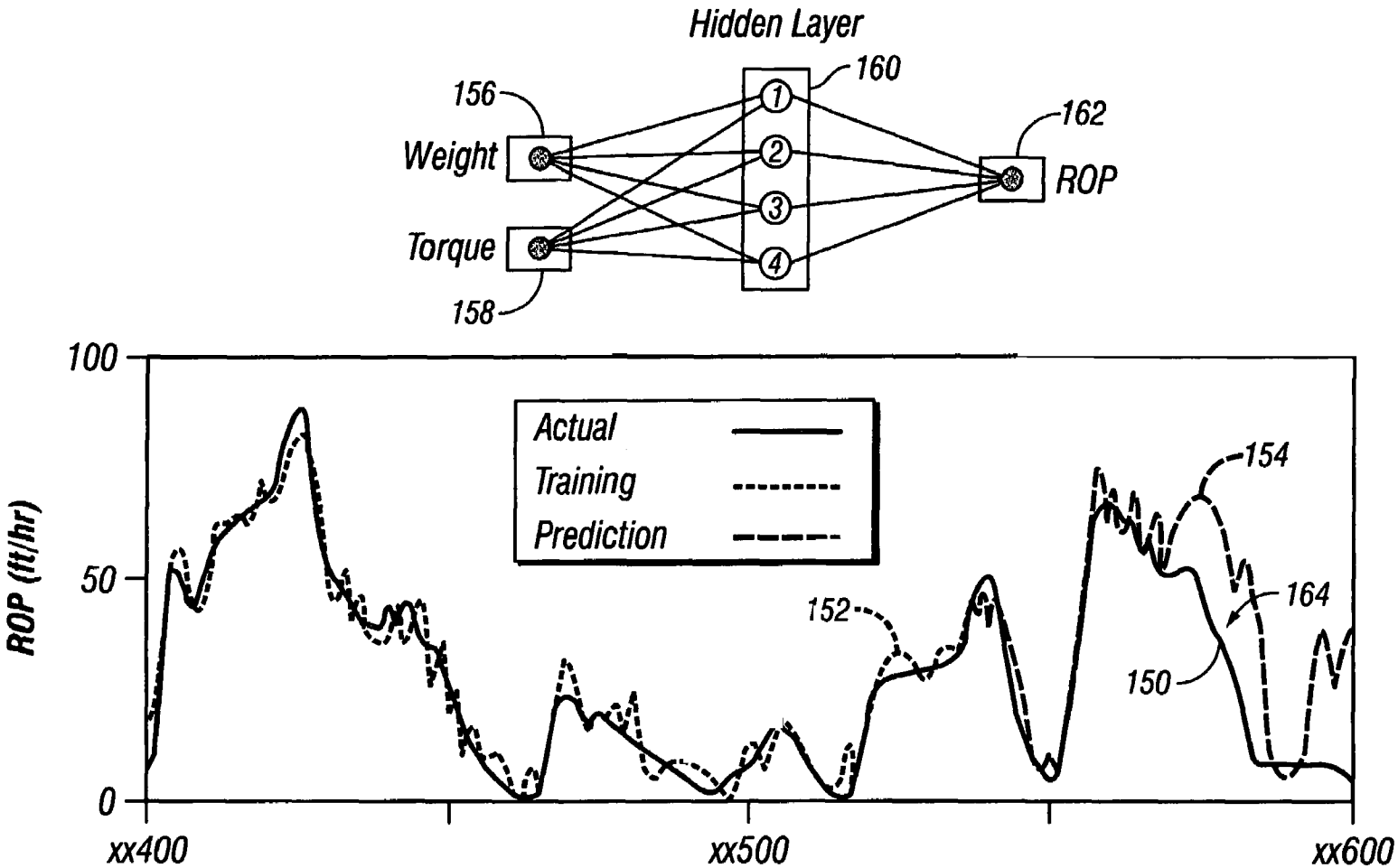

One example of a process for controlling drilling operations using "enhanced" data (for example, characterized according to the example process shown in FIG. 6) is shown in FIG. 7. In FIG. 7, at 120, drilling operating parameters, and drilling response parameters can be correlated to the depth in the wellbore at which each parameter is recorded with respect to time. Examples of drilling operating parameters include, without limitation, weight on bit, drilling fluid flow rate, and rotating rate of the drill string (RPM). The foregoing are referred to as drilling operating parameters because they are within the direct control of, and are selected by the drilling rig operator. Drilling response parameters include, for example, rate of penetration, torque, and accelerations (axial, torsional, lateral and/or whirling) experienced by various components of the drill string. The foregoing are referred to as response parameters because they are a result of the drilling operating parameters, the configuration of the drill string and the earth formations being drilled, among other factors, and are therefore typically not under direct control of the drilling rig operator. It should be noted that some drilling rigs have equipment adapted to enable the drilling rig operator to select the torque applied to the drill string at the surface. On such drilling rigs, surface torque may in fact be a drilling operating or control parameter.

At 122 in FIG. 7, data corresponding to the composition and the mechanical properties of the various earth formations penetrated by the wellbore are entered into a correlation program. Typically, data corresponding to the composition and mechanical properties of the earth formations ("lithology" data) are recorded with respect to depth in the wellbore if they are recorded using so-called "wireline" well logging instruments. In order to use depth referenced data for purposes of controlling drilling operations, it is convenient to, and in the present embodiment, at 124, the lithology data are converted from depth-referenced records, to time at which the measurements of the various drilling parameters were made. Thus referenced with respect to time, the composition and mechanical property data can be indexed to the drilling operating parameters and drilling response parameters corresponding to the time of drilling through the respective formation. Conversion from depth reference to time reference thus makes subsequent use of the lithology data more effective in analysis used to control drilling operations that will be further explained below. Examples of data which may be used to characterize the earth formations according to composition and mechanical properties (lithology) include, without limitation, drill cuttings description, drilling exponent, formation hardness, electrical resistivity, natural gamma radiation, neutron porosity, bulk density, and acoustic interval travel time.

It should be noted that changing the reference index of lithology data from depth to time may require some interpolation of data values between recorded values. Methods for interpolation are well known in the art and include linear and cubic spline. The actual form of interpolation is not intended to limit the scope of the invention. It should also be understood that lithology data may be recorded during drilling of the wellbore using well known MWD sensors. MWD data are typically recorded with respect to time, however the recording rates may differ from the measurement sample and recording rate of the sensors disposed at the earth's surface and measurements from different sensors recorded at any one time relate to formations at different offset depths. Therefore, MWD formation data need to be correlated in the depth domain, then transformed back into the time domain and re-sampled to have a data record "density" (samples per unit time) substantially the same as the drilling data recorded either downhole or at the earth's surface.

At 126 in FIG. 7, "enhancement" characterization of the drilling operating parameters, drilling response parameters and lithology data is performed, for example as explained above with reference to FIG. 6, to determine whether the data are likely to be reliable for subsequent analysis. Data corresponding to times at which the drill string underwent excessive acceleration, or data which changed to an excessive degree from one sample interval to the next, may be excluded from further processing, as shown at 128. Data which are recorded during times of relatively difference-free and/or acceleration-free drill string motion are selected for further processing.

Figure 6A:
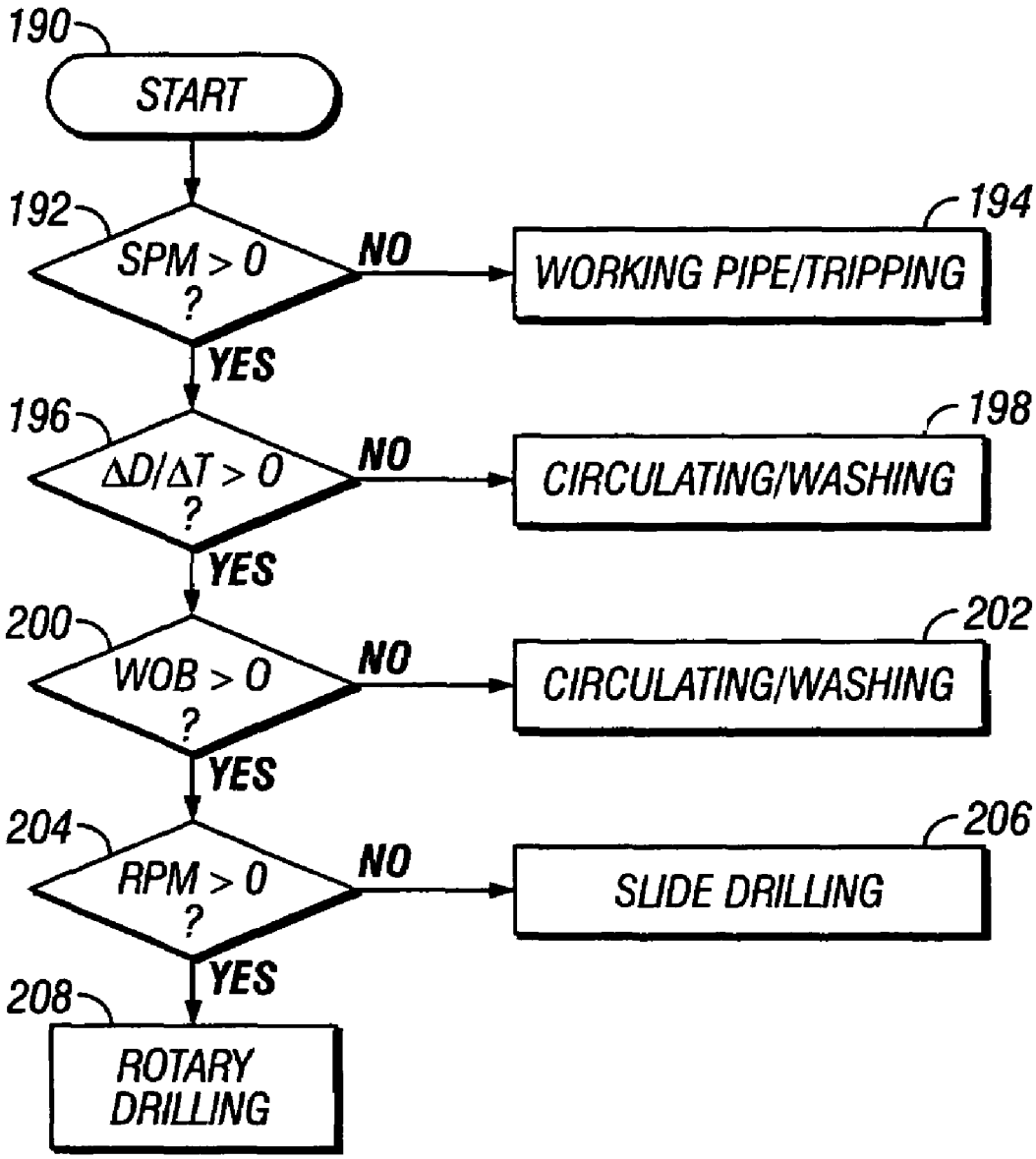
FIG. 6A shows an example process for determining drilling rig operating state.

In the present embodiment, at 130 in FIG. 7, data recorded during times at which the drilling operation is "slide drilling" can be separated from data recorded during times at which the data are "rotary drilling." To separate data accordingly, it is necessary to determine the state of drilling rig operations at the time of data recording as is well known in the art. One example process for determining drilling rig operating state is shown in FIG. 6A. To perform the process in FIG. 6A, certain parameters are measured, such as bit position (hook position), the maximum wellbore depth, the hook load, the operating rate of the drilling mud pumps (measurable either by a "stroke counter" known in then art or by measuring drill string pressure), and the rotary speed (RPM) of the top drive (or rotary table). At 190 the process begins. For example, at 192, a Boolean logic routine queries whether the mud pumps have more than zero operating rate or output pressure. If not, and the bit position is changing (as a result of hook movement or change in hook load), the bit position is less than the total wellbore depth and the drill string is not rotating (RPM=0), the drilling mode is determined to be tripping pipe in or tripping pipe out (removing or inserting the drill string into the wellbore), at 194. As another example, if the mud pump has non-zero output, at 196, the routine queries whether the change in bit depth is greater than zero with respect to time, the bit depth is less than the hole depth and the drill string is not rotating. If, with these additional conditions, the bit position is not changing, at 198, the mode is determined to be circulating. Another example is when the bit position is increasing or constant with the mud pump pressure greater than zero and bit position equal to the total wellbore depth. Under these conditions, at 204, the rotary top drive speed is interrogated. If the speed is greater than zero, at 208, the mode is rotary drilling. If the rotary speed is zero, at 206, then the mode is slide drilling. Another example is when the measured hookload is substantially equal to the weight of the top drive, the mud pump pressure (measured by transducer 28 in FIG. 1) is zero and the RPM is zero, with the bit position less than the wellbore depth. Under these conditions the drilling mode is determined to be "in slips" during such operations as adding additional length to the drill string. The foregoing are only some examples of determining drilling mode by interrogating selected data values. For purposes of this aspect of the invention, the important drilling rig operating modes are slide drilling and rotary drilling.

Referring back to FIG. 7, at 132, the combinations of drilling response parameters and drilling operating parameters are characterized with respect to a most likely lithology or formation property. Determining the most likely lithology or formation property for combinations of drilling operating parameters and drilling response parameters may be performed, for example, by using an artificial neural network, Bayesian network, regression analysis, error function analysis, or other methods known in the art for characterization. As a result, measuring particular drilling responses for particular drilling operating parameters may provide the ability to determine the lithology only from the measured drilling operating parameters and drilling response parameters. Drilling response, as previously explained, may include rate of penetration, drill string torque and acceleration (lateral, torsional, axial and/or whirling) of the drill string, as previously explained. At 134, the drilling data are then characterized according to the various types of formations penetrated during drilling as determined from formation data sources well known in the art such as, but not limited to, "wireline" well log measurements, analysis (lithological description) of drill cuttings returned to the earth's surface through the drilling fluid, core samples drilled through the various formations and/or MWD formation evaluation sensor data. The drilling data are separated according to groups of drilling mode and similar composition and/or mechanical properties. As will be appreciated by those skilled in the art, such separation may include separation into groups having typical earth formation compositions associated with wellbore drilling, such as "hard formation", "soft formation", "shale", "sandstone", "limestone" and "dolomite." The foregoing classifications are merely examples and are not intended to limit the classification of the various lithologies used in any particular embodiment of a method according to this aspect of the invention.

At 136, a preferred set of drilling operating parameters is determined for each lithology. A preferred set of drilling operating parameters may be determined, for example, when a rate of penetration is at a maximum and amounts of lateral, axial, torsional and whirling acceleration of the drill string are at a minimum, for each lithology. Determining preferred drilling operating parameters may be performed, for example, by using an artificial neural network, Bayesian network, regression analysis, error function analysis, or other methods known in the art for optimization.

At 138, during actual drilling of a wellbore, measurements of drilling operating parameters and drilling response parameters are made. At 140, the drilling operating parameter measurements, and drilling response parameter measurements are characterized, such as explained above with respect to FIG. 6. If the measurements fall outside the selection criteria used to determined enhanced data, as shown at 142, the values of the drilling operating parameters extant at the time of the characterization may be maintained. If the drilling measurements are such that the enhanced data set selection criteria are met, then the process continues. At 144, the drilling operating mode (sliding or rotating) is determined. At 146, a most likely lithology is determined from the drilling operating parameters and the drilling response parameters. At 148, a preferred set of drilling operating parameters is applied to control the drilling rig (10 in FIG. 1) according to the lithology determined at 146.

FIG. 8 shows an example of using drilling response measurements, lithology characterization and drilling operating parameter measurements to predict drilling response. Predicted drilling response can be compared to actual drilling response to determine a drilling malfunction. The graph in FIG. 8 shows a measured rate of penetration, at curve 150. Curve 152 represents a rate of penetration curve developed by a trained artificial neural network (ANN). As shown in the upper part of FIG. 8, the ANN may be trained by entering drilling operating parameters, such as weight on bit 156 and rotary torque 158. Other drilling operating parameters may include RPM and drilling mud flow rate, for example. As is known in the art, weighting factors in the hidden layer 160 of the ANN adjust such that a response output, in this example rate of penetration 162 most closely matches the actual response for the particular set of input parameters to the ANN, in this example weight 156 and torque 158.

At curve 154 in FIG. 8, a predicted drilling response is then generated from the trained ANN for inputs comprising drilling operating parameters. The actual drilling response 150 is compared to the predicted drilling response. Intervals, such as shown at 164, in which there is substantial difference between the predicted drilling response and the measured drilling response, may be indicative of a drilling malfunction. Examples of drilling malfunctions include, without limitation, a worn drill bit, a worn or broken drill string component, unexpected lithology change, and unexpected drill string acceleration. In some embodiments, indications of a drilling malfunction may be used to provide an alarm or other indication to the drilling rig operator or wellbore operator of the malfunction.

Embodiments of a system and methods according to the various aspects of the invention may provide improved time to depth correlation, improved accuracy in bit and wellbore depth determination, improved determination of rates of drilling penetration and parameters related thereto, improved selection of drilling operating parameters from enhanced drilling data and improved detection of drilling malfunctions from enhanced drilling data.

All of the foregoing embodiments of the invention, as well as other embodiments, may be implemented as logic instructions to operate a programmable computer. The logic instructions may be stored in any form of computer readable medium known in the art.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for determining a depth of a wellbore, comprising:

determining change in a suspended weight of a drill string from a first time to a second time;

determining a change in axial position of the upper portion of the drill string between the first time and the second time;

correcting an expected amount of drill string compression related to the change in suspended weight for movement of a lower portion of the drill string between the first time and the second time; and calculating a position of the lower portion of the drill string from the change in axial position and the corrected amount of drill string compression.

2. The method as defined in claim 1 further comprising determining whether the drill string is not rotating at the earth's surface, and adjusting the corrected change in axial position for friction between a wall of the wellbore and the drill string when the drill string is not rotating.

3. The method as defined in claim 1 further comprising calculating a rate of penetration of the wellbore between the first time and the second time.

4. The method as defined in claim 3 wherein the rate of penetration is set equal to zero at the second time if the corrected change in axial position is indicative of no increase in the depth.

5. The method as defined in claim 4 further comprising calculating a drilling exponent from the rate of penetration.

6. The method of claim 1 wherein the movement of the lower portion of the drill string is estimated by determining an axial motion of the drill string at the earth's surface between two times having a same suspended weight of the drill string.

7. A program recorded in a computer readable medium, the program including logic operable to cause a programmable computer to perform steps comprising:

determining change in a suspended weight of a drill string from a first time to a second time;

determining a change in axial position of the upper portion of the drill string between the first time and the second time;

correcting an expected amount of drill string compression related to the change in suspended weight for movement of a lower portion of the drill string between the first time and the second time; and calculating a position of the lower portion of the drill string from the change in axial position and the corrected amount of drill string compression.

8. The program of claim 7 wherein the logic further comprises instructions to cause the computer to perform determining whether the drill string is not rotating at the earth's surface, and adjusting the corrected change in axial position for friction between a wall of the wellbore and the drill string when the drill string is not rotating.

9. The program of claim 7 wherein the logic further comprises instructions to cause the computer to perform determining a change in depth between the first time and the second time, and calculating a rate of penetration of the wellbore between the first time and the second time.

10. The program of claim 9 wherein the rate of penetration is set equal to zero at the second time if the corrected change in axial position is indicative of no increase in the depth.

11. The program of claim 10 wherein the logic further comprises instructions to cause the computer to perform calculating a drilling exponent from the rate of penetration.

12. The program of claim 7 wherein logic instructions to determine the movement of the lower portion of the drill string comprise instructions causing the computer to estimate the movement by determining an axial motion of the drill string at the earth's surface between two times having a same suspended weight of the drill string.

* * * * *